United States Patent [19]

Wade et al.

[11] Patent Number: 4,677,001

[45] Date of Patent: Jun. 30, 1987

[54] METHOD OF CREATING RELIEF TYPE DESIGNS

[76] Inventors: Catherine C. Wade, Rte. 5, Box 1-A, Turtle Creek Farm; Yvonne B. McKercher, Rte. 5, Box 253-8, both of Apex, N.C. 27502

[21] Appl. No.: 658,748

[22] Filed: Oct. 9, 1984

[51] Int. Cl.[4] ..... B05D 5/00

[52] U.S. Cl. ..... 427/264; 427/265; 427/270; 427/277

[58] Field of Search ..... 427/264, 270, 277, 265; 434/82

[56] References Cited

U.S. PATENT DOCUMENTS

| | | | |
|---|---|---|---|
| 1,899,488 | 2/1933 | Weber | 427/264 X |
| 3,891,582 | 6/1975 | Desmarais | 524/45 X |
| 4,105,816 | 8/1978 | Hori | 427/264 X |
| 4,277,387 | 7/1981 | Jordan, Jr. et al. | 524/292 |
| 4,390,372 | 6/1983 | Hardin | 106/90 |

*Primary Examiner*—Evan K. Lawrence
*Attorney, Agent, or Firm*—Mills & Coats

[57] ABSTRACT

A method of creating decorative designs by blending a spackling compound with a caulking compound and thickening the mixture with dry masonry repair compound. Water is added as needed for thinning and paint is used to obtain the desired coloration. A plurality of different colored batches can be prepared so that multicolored designs or decorations can be produced. The blend used in the method of the present invention can be shaped into almost any desired design on almost any dry surface or the designs can be created on wax paper and transferred to the final surface using uncured product as the bonding agent.

8 Claims, 3 Drawing Figures

METHOD OF CREATING RELIEF TYPE DESIGNS

FIELD OF THE INVENTION

This invention relates to methods of creating relief type designs.

BACKGROUND OF THE INVENTION

Since man first became capable of producing drawings and designs, he has been attempting to improve the same. Painting has developed from line drawings by cavemen to the sophisticated art treasurers of today. Likewise, sculpturing and sculptured type decorating has moved from early figures and designs formed from wood and stone to the decorative ornamentations created by modern man. Additionally, people of all ages, sexes and races enjoy being creative, whether it is a housewife decorating a birthday cake, a student decoupaging a design off an old T-shirt or a retired person taking up painting for the first time.

All of the above art forms have their own particular frustrations such as the cake decorator creating a work of art that is not permanent, the decoupager who has to wait many hours between each step of that process for the same to dry, and the artist who has colors running together and must try to create the appearance of three dimensions when working with only two dimensions.

SUMMARY OF THE INVENTION

After much research and study into the above-mentioned problems, the present invention has been developed to provide a means and method of creating three dimensional designs which are simple to prepare, easy to apply and shape, do not have color ooze or bleeding, may be layered as many times as required, and can be layered even when the previous layer has not dried. Realistic relief configurations such as flowers, foliage, figures and even simulated displayed looking products are readily formable and are permanent in nature as well as being extremely tough and durable. Should chipping occur, the application of sealer thereover restores the design to its original beauty with little or no evidence of damage having occurred.

The above is accomplised through the blending of products used in the building trade and then creating relief type artwork therefrom.

In view of the above, it is an object of the present invention to provide a method for creating three-dimensional, relief type designs on suitable support surfaces.

Another object of the present invention is to provide a method for creating relief type designs that are weather resistant, tough, and non-fading.

Another object of the present invention is to provide a method of producing relief type three-dimensional designs utilizing readily commercial available products.

Another object of the present invention is to provide a method of producing multiple colored three-dimensional designs with fixed colors which will not ooze or bleed.

Another object of the present invention is to provide a method for creating relief type design which is composed of multiple colors in multiple layers.

Other objects and advantages of the present invention will become apparent and obvious from a study of the following description and the accompanying drawings which are merely illustrative of such invention.

DETAILED DESCRIPTION OF INVENTION

Figure 1:
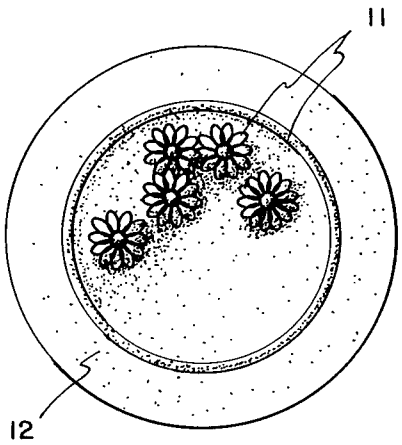
FIG. 1 is a top plan view of a composite design utilizing the means and methods of the present invention.
Figure 2:
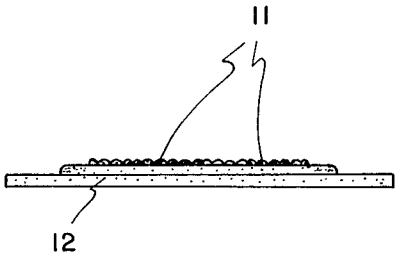
FIG. 2 is an elevational view thereof.
Figure 3:
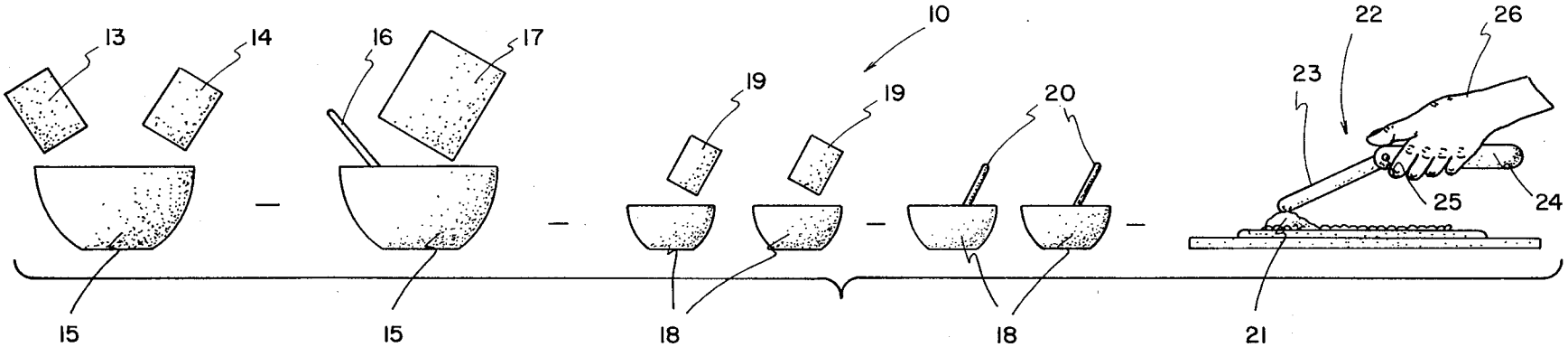
FIG. 3 illustrates the method of preparation of the present invention.

With further reference to the drawings, the method of creating decorative type designs is illustrated in FIG. 3 and indicated generally at 10. The result of this method is the relief creation 11 permanently mounted on backing 12.

To form the relief creation 11, a vinyl spackling compound 13 and a vinyl latex caulking compound 14 are removed from their respective containers in a ratio of approximately 10 to 1 and placed in a mixing container 15 and are blended together by means such as stirrer 16.

The spackling compound is preferably in the form of a paste.

The viscosity of the mixture can be altered as desired by adding either a thickening agent such as a dry masonry compound to increase viscosity or a compatible liquid such as water to decrease viscosity as is clearly shown at 17.

The proportions of the blend must be such as to allow the blend to be shaped into a relief type design.

Next, the blend of the present invention is placed in a plurality of smaller containers 18 with each receiving a coloring substance 19. Standard acrylic paints which are readily commercially available have been found suitable for this purpose.

The coloring 19 is blended into the material in containers 18 by means such as stirrers 20 to complete the preparation of the decorating substance 21 of the present invention.

A forming and shaping tool, indicated generally at 22, includes a blade portion 23 which is preferably constructed from spring steel, is approximately six inches long, and is rounded at its tip. This blade portion is preferably pivotable mounted to handle portion 24 by means such as pivot pin 25. By having the blade portion pivot relatively to the handle portion, any comfortable angular relationship therebetween can be assumed by the user 26 thereof. Once use of the blade has been completed, the blade can be cleaned and stored in the handle similar to the folding of the blade of a pocketknife. Feeler gauges having a length of approximately six to six and half inches have been found very suitable for use as a shaper as well as standard artist palette knives.

Through use of the process of the present invention, relief or multi-dimensional designs can be created on virtually any clean, dry surface. The basic mixture is pure white prior to being tinted to the desired color. Also the mixture can be thinned or thickened to obtain the desired viscosity or consistency as mentioned above.

The means of the present invention can be layered to obtain a true three-dimensional effect and the various colors used do not ooze or bleed. As many layers as desired can be used and the colors blended as desired. The drying of each layer makes it easier to overlay the next layer but is not necessary in creating the decorative designs of the present invention.

If desired, the designs 11 can be shaped on wax paper. Once such design has been completed, the paper can be peeled from the back thereof and a small amount of the mixture of the present invention used to adhere the design to the desired mounting surface 12.

The mixture of the present invention can be applied and shaped with the shaping tool 22 described above or it can be used with standard cake decorating tools. As soon as the decorating has been completed, all tools should be washed thoroughly in warm water to remove any mixture therefrom before the same hardens.

Once the decorative design of the present invention has completely dried, two finishing coats of sealer such as shellac, lacquer, or polyurethane are applied, allowing thorough drying between coats. This sealer can be applied by either brushing or spraying. Clear shellac, lacquers and polyurethanes are readily commercially available and further detailed discussion of the same is not deemed necessary.

The completed artwork or designs of the present invention can be cleaned with a damp cloth and should chipping occur, the design can be repaired by simply applying additional sealer to the chipped area to restore its original appearance.

A suitable water soluble vinyl spackling compound which is readily commercially available is "DAP Vinyl Spackling" manufactured by DAP, Inc., of Dayton, Ohio 45401. This spackling compound meets federal specification SS-P-00450 Type II, and contains no asbestos. A suitable water soluble vinyl caulking compound which is readily commercially available is "DAP Vinyl Latex Caulking Compound" and also manufactured by DAP, Inc., and meets ATSM Specification C834-76. A suitable dry masonry repair compound for thickening the decorating means of the present invention and which is readily commercially available is "SYNKO Spackling Powder" manufactured by Synko Loid Co., of Bayonne, New Jersey 07002.

Although certainly not intended for ingestion, the means of the present invention is safe for children to work with and is suitable for use by both the beginner and the highly skilled artisan. Creations can be formed from designs by preschoolers to masterpieces of art and all are permanent, extremely tcugh, and can withstand extreme abuse without asthetic or structural harm.

From the above it can be seen that the present invention has the advantage of providing a truly new form of art in three dimensional or relief form that is permanent in nature, adheres to almost any surface, is easy to work with, and is rewarding in the final results that are accomplished.

The present invention can, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to embraced therein.

What is claimed is:

1. The method of creating relief type designs comprising: blending a water-soluble vinyl spackling compound and a water-soluble vinyl latex caulking compound in such proportions as to allow the blend to be shaped into a relief type design; tinting said blend to a desired color; applying said blend to a suitable support surface; and shaping said blend on said surface whereby a three-dimensional relief type design can be created.

2. The method of claim 1 wherein said blend is divided into at least two batches prior to tinting the blend and wherein a different color tinting is added to each batch.

3. The method of claim 3 wherein said blend is layered on said surface.

4. The method of claim 1 wherein the color tinting is done with paint.

5. The method of claim 4 wherein said paint is of the acrylic type.

6. The method of claim 1 further comprising adding a compatible liquid to the blend to decrease the viscosity thereof.

7. The method of claim 6 wherein said liquid is water.

8. The method of claim 1 wherein a blade-like means is used for shaping said blend.

* * * * *